US006870507B2

(12) United States Patent
Anguera Pros et al.

(10) Patent No.: US 6,870,507 B2
(45) Date of Patent: Mar. 22, 2005

(54) MINIATURE BROADBAND RING-LIKE MICROSTRIP PATCH ANTENNA

(75) Inventors: Jaume Anguera Pros, Vinaros (ES); Carles Puente Baliarda, Barcelona (ES); Carmen Borja Borau, Barcelona (ES)

(73) Assignee: Fractus S.A., Sant Cugat Valles (ES)

( * ) Notice: Subject to any disclaimer, the term of this patent is extended or adjusted under 35 U.S.C. 154(b) by 5 days.

(21) Appl. No.: 10/632,604

(22) Filed: Aug. 1, 2003

(65) Prior Publication Data

US 2004/0061648 A1 Apr. 1, 2004

Related U.S. Application Data

(63) Continuation of application No. PCT/EP01/01287, filed on Feb. 7, 2001.

(51) Int. Cl.[7] ..... H01Q 1/38

(52) U.S. Cl. ..... 343/700 MS; 343/792.5; 343/702; 343/787

(58) Field of Search ..... 343/700 MS, 702, 343/792.5, 787, 753, 754, 756, 853, 757, 763

(56) References Cited

U.S. PATENT DOCUMENTS

| | | | | |
|---|---|---|---|---|
| 3,521,284 | A | 7/1970 | Sheldon, Jr. et al. | 343/702 |
| 3,599,214 | A | 8/1971 | Altmayer | 343/724 |
| 3,622,890 | A | 11/1971 | Fujimoto et al. | 134/198 |
| 3,683,376 | A | 8/1972 | Pronovost | 342/28 |
| 3,818,490 | A | 6/1974 | Leahy | 343/727 |
| 3,967,276 | A | 6/1976 | Goubau | 343/752 |
| 3,969,730 | A | 7/1976 | Fuchser | 343/770 |
| 4,024,542 | A | 5/1977 | Ikawa et al. | 343/702 |
| 4,131,893 | A | 12/1978 | Munson et al. | 343/700 MS |
| 4,141,016 | A | 2/1979 | Nelson | 343/858 |
| 4,471,358 | A | 9/1984 | Glasser | 342/12 |
| 4,471,493 | A | 9/1984 | Schober | 455/575.7 |
| 4,504,834 | A | 3/1985 | Garay et al. | 343/749 |
| 4,543,581 | A | 9/1985 | Nemet | 343/702 |
| 4,571,595 | A | 2/1986 | Phillips et al. | 343/745 |
| 4,584,709 | A | 4/1986 | Kneisel et al. | 455/78 |
| 4,590,614 | A | 5/1986 | Erat | 455/270 |
| 4,623,894 | A | 11/1986 | Lee et al. | 343/700 MS |
| 4,673,948 | A | 6/1987 | Kuo | 343/700 MS |

(List continued on next page.)

FOREIGN PATENT DOCUMENTS

| | | |
|---|---|---|
| DE | 3337941 | 5/1985 |
| EP | 0096847 | 12/1983 |
| EP | 0297813 | 6/1988 |

(List continued on next page.)

OTHER PUBLICATIONS

Anguera, J. et al. "Miniature Wideband Stacked Microstrip Patch Antenna Based on the Sierpinski Fractal Geometry," IEEE Antennas and Propagation Society International Symposium, 2000 Digest. Aps., vol. 3 of 4, pp. 1700–1703 (Jul. 16, 2000).

(List continued on next page.)

*Primary Examiner*—Don Wong
*Assistant Examiner*—Chuc Tran
(74) *Attorney, Agent, or Firm*—Jones Day

(57) ABSTRACT

A miniature broadband stacked microstrip patch antenna formed by two patches, an active and a parasitic patches, where at least one of them is defined by a Ring-Like Space-Filling Surface (RSFS) being this RSFS newly defined in the present invention. By means of this novel technique, the size of the antenna can be reduced with respect to prior art, or alternatively, given a fixed size the antenna can operate at a lower frequency with respect to a conventional microstrip patch antenna of the same size and with and enhanced bandwidth. Also, the antennas feature a high-gain when operated at a high order mode.

6 Claims, 10 Drawing Sheets

U.S. PATENT DOCUMENTS

| | | | | | |
|---|---|---|---|---|---|
| 4,730,195 | A | | 3/1988 | Phillips et al. | 455/272 |
| 4,839,660 | A | | 6/1989 | Hadzoglou | 455/270 |
| 4,843,468 | A | | 6/1989 | Drewery | 343/702 |
| 4,847,629 | A | | 7/1989 | Shimazaki | 343/702 |
| 4,849,766 | A | | 7/1989 | Inaba et al. | 343/700 MS |
| 4,857,939 | A | | 8/1989 | Shimazaki | 449/24 |
| 4,890,114 | A | | 12/1989 | Egashira | 343/702 |
| 4,894,663 | A | | 1/1990 | Urbish et al. | 343/700 M |
| 4,907,011 | A | | 3/1990 | Kuo | 343/700 MS |
| 4,912,481 | A | | 3/1990 | Mace et al. | 273/42 R |
| 4,975,711 | A | | 12/1990 | Lee | 343/702 |
| 5,030,963 | A | | 7/1991 | Tadama | 343/702 |
| 5,138,328 | A | | 8/1992 | Zibrik et al. | 343/702 |
| 5,168,472 | A | | 12/1992 | Lockwood | 343/703 MS |
| 5,172,084 | A | | 12/1992 | Fiedziuszko et al. | 426/482 |
| 5,200,756 | A | | 4/1993 | Feller | 205/170 |
| 5,210,542 | A | * | 5/1993 | Pett et al. | 343/700 MS |
| 5,214,434 | A | | 5/1993 | Hsu | 343/700 MS |
| 5,218,370 | A | | 6/1993 | Blaese | 343/702 |
| 5,227,804 | A | | 7/1993 | Oda | 343/702 |
| 5,227,808 | A | | 7/1993 | Davis | 343/702 |
| 5,245,350 | A | | 9/1993 | Sroka | 455/270 |
| 5,248,988 | A | | 9/1993 | Makino | 455/575.7 |
| 5,255,002 | A | | 10/1993 | Day | 455/270 |
| 5,257,032 | A | | 10/1993 | Diamond et al. | 455/270 |
| 5,347,291 | A | | 9/1994 | Moore | 343/700 MS |
| 5,355,144 | A | | 10/1994 | Walton et al. | 343/702 |
| 5,355,318 | A | | 10/1994 | Dionnet et al. | 343/702 |
| 5,373,300 | A | | 12/1994 | Jenness et al. | 343/702 |
| 5,402,134 | A | | 3/1995 | Miller et al. | 343/385 |
| 5,420,599 | A | | 5/1995 | Erkocevic | 343/858 |
| 5,422,651 | A | | 6/1995 | Chang | 343/700 MS |
| 5,451,965 | A | | 9/1995 | Matsumoto | 343/702 |
| 5,451,968 | A | | 9/1995 | Emery | 343/749 |
| 5,453,751 | A | | 9/1995 | Tsukamoto et al. | 343/700 MS |
| 5,457,469 | A | | 10/1995 | Diamond et al. | 343/702 |
| 5,471,224 | A | | 11/1995 | Barkeshli | 445/270 |
| 5,493,702 | A | | 2/1996 | Crowley et al. | 455/270 |
| 5,495,261 | A | | 2/1996 | Baker et al. | 343/846 |
| 5,534,877 | A | | 7/1996 | Sorbello et al. | 343/700 MS |
| 5,537,367 | A | | 7/1996 | Lockwood et al. | 343/702 |
| H001631 | H | | 2/1997 | Montgomery et al. | 343/700 MS |
| 5,619,205 | A | | 4/1997 | Johnson | 343/702 |
| 5,684,672 | A | | 11/1997 | Karidis et al. | 343/700 MS |
| 5,712,640 | A | | 1/1998 | Andou et al. | 343/749 |
| 5,767,811 | A | | 6/1998 | Mandai et al. | 343/702 |
| 5,798,688 | A | | 8/1998 | Schofield | 343/700 MS |
| 5,821,907 | A | | 10/1998 | Zhu et al. | 343/702 |
| 5,841,403 | A | | 11/1998 | West | 343/702 |
| 5,870,066 | A | | 2/1999 | Asakura et al. | 343/895 |
| 5,872,546 | A | | 2/1999 | Ihara et al. | 343/702 |
| 5,898,404 | A | | 4/1999 | Jou | 343/702 |
| 5,903,240 | A | | 5/1999 | Kawahata et al. | 343/700 MS |
| 5,926,141 | A | | 7/1999 | Lindenmeier et al. | 343/713 |
| 5,943,020 | A | | 8/1999 | Liebendoerfer et al. | 280/735 |
| 5,966,098 | A | | 10/1999 | Qi et al. | 343/713 |
| 5,973,651 | A | | 10/1999 | Suesada et al. | 343/702 |
| 5,986,610 | A | | 11/1999 | Miron | 343/700 MS |
| 5,990,838 | A | | 11/1999 | Burns et al. | 343/713 |
| 6,002,367 | A | | 12/1999 | Engblom et al. | 340/572.1 |
| 6,028,568 | A | | 2/2000 | Asakura et al. | 343/702 |
| 6,031,499 | A | | 2/2000 | Dichter | 343/700 MS |
| 6,031,505 | A | | 2/2000 | Qi et al. | 343/795 |
| 6,034,645 | A | * | 3/2000 | Legay et al. | 343/769 |
| 6,078,294 | A | | 6/2000 | Mitarai | 343/772 |
| 6,091,365 | A | | 7/2000 | Derneryd et al. | 343/700 MS |
| 6,097,345 | A | | 8/2000 | Walton | 343/781 R |
| 6,104,349 | A | | 8/2000 | Cohen | 343/702 |
| 6,127,977 | A | * | 10/2000 | Cohen | 343/700 MS |
| 6,131,042 | A | | 10/2000 | Lee et al. | 343/702 |
| 6,140,969 | A | | 10/2000 | Lindenmeier et al. | 343/700 MS |
| 6,140,975 | A | | 10/2000 | Cohen | 343/700 MS |
| 6,160,513 | A | | 12/2000 | Davidson et al. | 343/700 MS |
| 6,172,618 | B1 | | 1/2001 | Hakozaki et al. | 343/702 |
| 6,211,824 | B1 | | 4/2001 | Holden et al. | 343/700 MS |
| 6,218,992 | B1 | | 4/2001 | Sadler et al. | 343/767 |
| 6,236,372 | B1 | | 5/2001 | Lindenmeier et al. | 343/713 |
| 6,266,023 | B1 | | 7/2001 | Nagy et al. | 340/572.1 |
| 6,281,846 | B1 | | 8/2001 | Puente Baliarda et al. | 343/795 |
| 6,307,511 | B1 | | 10/2001 | Ying et al. | 343/781 R |
| 6,329,951 | B1 | | 12/2001 | Wen et al. | 343/702 |
| 6,329,954 | B1 | | 12/2001 | Fuchs et al. | 343/702 |
| 6,367,939 | B1 | | 4/2002 | Carter et al. | 343/700 MS |
| 6,407,710 | B2 | | 6/2002 | Keilen et al. | 343/795 |
| 6,417,810 | B1 | | 7/2002 | Huels et al. | 343/713 |
| 6,431,712 | B1 | | 8/2002 | Turnbull | 359/604 |
| 6,445,352 | B1 | | 9/2002 | Cohen | 343/755 |
| 6,452,549 | B1 | | 9/2002 | Lo | 359/443 |
| 6,452,553 | B1 | | 9/2002 | Cohen | 701/36 |
| 6,476,766 | B1 | * | 11/2002 | Cohen | 343/700 MS |
| 6,525,691 | B2 | * | 2/2003 | Varadan et al. | 343/700 MS |
| 6,552,690 | B2 | | 4/2003 | Veerasamy | 343/713 |
| 2002/0000940 | A1 | | 1/2002 | Moren et al. | 426/482 |
| 2002/0000942 | A1 | | 1/2002 | Duroux | 73/204.11 |
| 2002/0036594 | A1 | | 3/2002 | Gyenes | 83/660 |
| 2002/0105468 | A1 | | 8/2002 | Tessier et al. | 273/142 R |
| 2002/0109633 | A1 | | 8/2002 | Ow et al. | 205/170 |
| 2002/0126054 | A1 | | 9/2002 | Fuerst et al. | 105/224.05 |
| 2002/0126055 | A1 | | 9/2002 | Lindenmeier et al. | 449/24 |
| 2002/0175866 | A1 | | 11/2002 | Gram | 116/108 |

FOREIGN PATENT DOCUMENTS

| | | |
|---|---|---|
| EP | 0358090 | 8/1989 |
| EP | 0543645 | 5/1993 |
| EP | 0571124 | 11/1993 |
| EP | 0688040 | 12/1995 |
| EP | 0765001 | 3/1997 |
| EP | 0814536 | 12/1997 |
| EP | 0871238 | 10/1998 |
| EP | 0892459 | 1/1999 |
| EP | 0929121 | 7/1999 |
| EP | 0932219 | 7/1999 |
| EP | 0969375 | 1/2000 |
| EP | 0986130 | 3/2000 |
| EP | 0942488 | 4/2000 |
| EP | 0997974 | 5/2000 |
| EP | 1018777 | 7/2000 |
| EP | 1018779 | 7/2000 |
| EP | 1071161 | 1/2001 |
| EP | 1094545 | 1/2001 |
| EP | 1079462 | 2/2001 |
| EP | 1083624 | 3/2001 |
| EP | 1096602 | 5/2001 |
| EP | 1148581 | 10/2001 |
| EP | 1198027 | 4/2002 |
| EP | 1237224 | 9/2002 |
| EP | 1267438 | 12/2002 |
| ES | 21122163 | 3/1998 |
| ES | 2142280 | 5/1998 |
| FR | 2543744 | 10/1984 |
| FR | 2704359 | 10/1994 |
| GB | 2215136 | 9/1989 |
| GB | 2330951 | 5/1999 |
| GB | 2355116 | 4/2001 |
| JP | 55147806 | 11/1980 |
| JP | 5007109 | 1/1993 |
| JP | 5129816 | 5/1993 |
| JP | 5267916 | 10/1993 |
| JP | 5347507 | 12/1993 |

| | | |
|---|---|---|
| JP | 6204908 | 7/1994 |
| JP | 10209744 | 8/1998 |
| WO | 9511530 | 4/1995 |
| WO | 9627219 | 9/1996 |
| WO | 9629755 | 9/1996 |
| WO | 9638881 | 12/1996 |
| WO | 9706578 | 2/1997 |
| WO | 9711507 | 3/1997 |
| WO | 9732355 | 9/1997 |
| WO | 9733338 | 9/1997 |
| WO | 9735360 | 9/1997 |
| WO | 9747054 | 12/1997 |
| WO | 9812771 | 3/1998 |
| WO | 9836469 | 8/1998 |
| WO | 9903166 | 1/1999 |
| WO | 9903167 | 1/1999 |
| WO | 9925042 | 5/1999 |
| WO | 9927608 | 6/1999 |
| WO | 9956345 | 11/1999 |
| WO | 0001028 | 1/2000 |
| WO | 0003453 | 1/2000 |
| WO | 0022695 | 4/2000 |
| WO | 0036700 | 6/2000 |
| WO | 0049680 | 8/2000 |
| WO | 0052784 | 9/2000 |
| WO | 0052787 | 9/2000 |
| WO | 0103238 | 1/2001 |
| WO | 0108257 | 2/2001 |
| WO | 0113464 | 2/2001 |
| WO | 0117064 | 3/2001 |
| WO | 0122528 | 3/2001 |
| WO | 0124314 | 4/2001 |
| WO | 0126182 | 4/2001 |
| WO | 0128035 | 4/2001 |
| WO | 0131739 | 5/2001 |
| WO | 0133665 | 5/2001 |
| WO | 0135491 | 5/2001 |
| WO | 0137369 | 5/2001 |
| WO | 0137370 | 5/2001 |
| WO | 0141252 | 6/2001 |
| WO | 0148861 | 7/2001 |
| WO | 0154225 | 7/2001 |
| WO | 0173890 | 10/2001 |
| WO | 0178192 | 10/2001 |
| WO | 0182410 | 11/2001 |
| WO | 0235646 | 5/2002 |
| WO | 02091518 | 11/2002 |
| WO | 02096166 | 11/2002 |

OTHER PUBLICATIONS

Hara Prasad, R.V., et al., "Microstrip Fractal Patch Antenna for Multi–Band Communication," Electronics Letters, IEE Stevenage, GB, vol. 36, No. 14, pp. 1179–1180 (Jul. 6, 2000).

Borja, C. et al., "High Directivity Fractal Boundary Microstrip Patch Antenna," Electronics Letters. IEE Stevenage, GB, vol. 36, No. 9, pp. 778–779 (Apr. 27, 2000).

International Search Report from the corresponding PCT patent application dated Oct. 22, 2001 (3 pgs.).

Ali, M. et al., "A Triple–Band Internal Antenna for Mobile Hand–held Terminals," IEEE, pp. 32–35 (1992).

Romeu, Jordi et al., "A Three Dimensional Hilbert Antenna," IEEE, pp. 550–553 (2002).

Parker et al., "Convoluted array elements and reduced size unit cells for frequency–selective surfaces," IEEE Proceedings H, vol. 138, No. pp. 19–22 (Feb. 1991).

Hansen, R.C., "Fundamental Limitations in Antennas," Proceedings of the IEEE, vol. 69, No. 2, pp. 170–182 (Feb. 1981).

Jaggard, Dwight L., "Fractal Electrodynamics and Modeling," Directions in Electromagnetic Wave Modeling, pp. 435–446 (1991).

Hohlfeld, Robert G. et al., "Self–Similarity and the Geometric Requirements for Frequency Independence in Antennae," Fractals, vol. 7, No. 1, pp. 79–84 (1999).

Samavati, Hirad, et al., "Fractal Capacitors," IEEE Journal of Solid–State Circuits, vol. 33, No. 12, pp. 2035–2041 (Dec. 1998).

Pribetich, P., et al., "Quasifractal Planar Microstrip Resonators for Microwave Circuits." Microwave and Optical Technology Letters, vol. 21, No. 6, pp. 433–436 (Jun. 20, 1999).

Zhang, Dawei, et al., "Narrowband Lumped–Element Microstrip Filters Using Capacitively–Loaded Inductors," IEEE MTT–S Microwave Symposium Digest, pp. 379–382 (May 16, 1995).

Gough, C.E., et al., "High Tc coplanar resonators for microwave applications and scientific studies," Physica C, NL,North–Holland Publishing, Amsterdam, vol. 282–287, No. 2001, pp. 395–398 (Aug. 1, 1997).

Radio Engineering Reference–Book by H. Meinke and F.V. Gundlah, vol. 1, Radio components. Circuits with lumped parameters. Transmission lines. Wave–guides. Resonators. Arrays. Radio wave propagation, States Energy Publishing House, Moscow, with English translation (1961) [4 pp.].

V.A. Volgov, "Parts and Units of Radio Electronic Equipment (Design & Computation)," Energiya, Moscow, with English translation (1967) [4 pp.].

Puente, C., et al., "Multiband properties of a fractal tree antenna generated by electrochemical deposition," Electronics Letters, IEE Stevenage, GB, vol. 32, No. 25, pp. 2298–2299 (Dec. 5, 1996).

Puente, C., et al., "Small but long Koch fractal monopole," Electronic Letters, IEE Stevenage, GB, vol. 34, No. 1, pp. 9–10 (Jan. 9, 1998).

Puente Baliarda, Carles, et al., "The Koch Monopole: A Small Fractal Antenna," IEEE Transactions on Antennas and Propagation, New York, US, vol. 48, No. 11, pp. 1773–1781 (Nov. 1, 2000).

Cohen, Nathan, "Fractal Antenna Applications in Wireless Telecommunications," Electronics Industries Forum of New England, 1997. Professional Program Proceedings Boston, MA US, May 6–8, 1997, New York, NY US, IEEE, US pp. 43–49 (May 6, 1997).

Sanad, Mohamed, "A Compact Dual–Broadband Microstrip Antenna Having Both Stacked and Planar Parasilic Elements," IEEE Antennas and Propagation Society International Symposium 1996 Digest, Jul. 21–26, 1996, pp. 6–9.

* cited by examiner

MINIATURE BROADBAND RING-LIKE MICROSTRIP PATCH ANTENNA

Amend the specification by inserting before the first line the sentence "This application is a continuation division of international application number PCT EP01 01287, filed Feb. 7, 2001 (status, abandoned, pending etc.)"

TECHNICAL FIELD

The present invention refers to a new family of microstrip patch antennas of reduced size and broadband behaviour based on an innovative set of curves named space-filling curves (SFC). The invention is specially useful in the environment of mobile communication devices (cellular telephony, cellular pagers, portable computers and data handlers, etc.), where the size and weight of the portable equipments need to be small.

BACKGROUND OF THE INVENTION

An antenna is said to be a small antenna (a miniature antenna) when it can be fitted in a space which is small compared to the operating wavelength. More precisely, the radiansphere is taken as the reference for classifying an antenna as being small. The radiansphere is an imaginary sphere of radius equal to the operating wavelength divided by two times $\pi$; an antenna is said to be small in terms of the wavelength when it can be fitted inside said radiansphere.

The fundamental limits on small antennas where theoretically established by H. Wheeler and L. J. Chu in the middle 1940's. They basically stated that a small antenna has a high quality factor (Q) because of the large reactive energy stored in the antenna vicinity compared to the radiated power. Such a high quality factor yields a narrow bandwidth; in fact, the fundamental limit derived in such theory imposes a maximum bandwidth given a specific size of an small antenna. Other characteristics of a small antenna are its small radiating resistance and its low efficiency.

The development of innovative structures that can efficiently radiate from a small space has an enormous commercial interest, especially in the environment of mobile communication devices (cellular telephony, cellular pagers, portable computers and data handlers, to name a few examples), where the size and weight of the portable equipments need to be small. According to R. C. Hansen (R. C. Hansen, "Fundamental Limitations on Antennas," Proc.IEEE, vol.69, no.2, February 1981), the performance of a small antenna depends on its ability to efficiently use the small available space inside the imaginary radiansphere surrounding the antenna. In the present invention, a novel set of geometries named ring-like space-filling surfaces (RSFS) are introduced for the design and construction of small antennas that improves the performance of other classical microstrip patch antennas described in the prior art.

A general configuration for microstrip antennas (also known as microstrip patch antenans) is well known for those skilled in the art and can be found for instance in (D. Pozar, "Microstrip Antennas: The Analysis and Design of Microstrip Antennas and Arrays". IEEE Press, Piscataway, N.J. 08855-1331). The advantages such antennas compared to other antenna configurations are its low, flat profile (such as the antenna can be conformally adapted to the surface of a vehicle, for instance), its convenient fabrication technique (an arbitrarily shaped patch can be printed over virtually any printed circuit board substrate), and low cost. A major draw-back of this kind of antennas is its narrow bandwidth, which is further reduced when the antenna size is smaller than a half-wavelength. A common technique for enlarging the bandwith of microstrip antennas is by means of a parasitic patch (a second patch placed on top of the microstrip antenna with no feeding mechanism except for the proximity coupling with the active patch) which enhances the radiation mechanism (a description of the parasitic patch technique can be found in J. F. Zurcher and F. E. Gardiol, "Broadband Patch Antennas", Artech House 1995.). A common disadvantage for such an stacked patch configuration is the size of the whole structure.

SUMMARY OF THE INVENTION

In this sense the present invention discloses a technique for both reducing the size of the stacked patch configuration and improving the bandwidth with respect to the prior art. This new technique can be obviously combined with other prior art miniaturization techniques such as loading the antenna with dielectric, magnetic or magnetodielectric materials to enhance the performance of prior art antennas.

The advantage of the present invention is obtaining a microstrip patch antenna of a reduced size when compared to the classical patch antennas, yet performing with a large bandwidth. The proposed antenna is based on a stacked patch configuration composed by a first conducting surface (the active patch) substantially parallel to a conducting ground counterpoise or ground-plane, and a second conducting surface (the parasitic patch) placed parallel over such active patch. Such parasitic patch is placed above the active patch so the active patch is placed between said parasitic patch an said ground-plane. One or more feeding sources can be used to excite the said active patch. The feeding element of said active patch can be any of the well known feeding element described in the prior art (such as for instance a coaxial probe, a co-planar microstrip line, a capacitive coupling or an aperture at the ground-plane) for other microstrip patch antennas.

The essential part of the invention is the particular geometry of either the active or the parasitic patches (or both). Said geometry (RSFS) consists on a ring, with an outer perimeter enclosing the patch and an inner perimeter defining a region within the patch with no conducting material. The characteristic feature of the invention is the shape of either the inner our outer perimeter of the ring, either on the active or parasitic patches (or in both of them). Said characteristic perimeter is shaped as an space-filing curve (SFC), i.e., a curve that is large in terms of physical length but small in terms of the area in which the curve can be included. More precisely, the following definition is taken in this document for a space-filling curve: a curve composed by at least ten segments which are connected in such a way that each segment forms an angle with their neighbours, i.e., no pair of adjacent segments define a larger straight segment, and wherein the curve can be optionally periodic along a fixed straight direction of space if and only if the period is defined by a non-periodic curve composed by at least ten connected segments and no pair of said adjacent and connected segments define a straight longer segment. Also, whatever the design of such SFC is, it never intersects with itself at any point except the initial and final points (that is, the whole curve is arranged as a closed loop definning either the inner or outer perimeter of one patch within the antenna conifiguration). Due to the angles between segments, the physical length of said space-filling curve is always larger than that of any straight line that can be fitted in the same area (surface) as said space-filling curve. Additionally, to properly shape the structure of the miniature patch antenna according to the present invention, the segments of the SFC curves must be shorter than a tenth of the free-space operating wavelength.

The function of the parasitic patch is to enhance the bandwidth of the whole antenna set. Depending on the thickness and size constrain and the particular application, a further size reduction is achieved by using the same essential configuration for the parasitic patch placed on top of the active patch.

It is precisely due to the particular SFC shape of the inner or outer (or both) perimeters of the ring on either the active or parasitic patches that the antenna features a low resonant frequency, and therefore the antenna size can be reduced compared to a conventional antenna. Due to such a particular geometry of the ring shape, the invention is named Microstrip Space-Filling Ring antenna (also MSFR antenna). Also, even in a solid patch configuration with no central hole for the ring, shaping the patch perimeter as an SFC contributes to reduce the antenna size (although the size reduction is in this case not as significant as in the ring case).

The advantage of using the MSFR configuration disclosed in the present document (FIG. 1) is threefold:

(a) Given a particular operating frequency or wavelength, said MSFR antenna has a reduced electrical size with respect to prior art.

(b) Given the physical size of the MSFR antenna, said antenna can operate at a lower frequency (a longer wavelength) than prior art.

(c) Given a particular operating frequency or wavelength, said MSFR antenna has a larger impedance bandwidth with respect to prior art.

Also, it is observed that when these antennas are operated at higher order frequency modes, they feature a narrow beam radiation pattern, which makes the antenna suitable for high gain applications.

As it will be readily notice by those skilled in the art, other features such as cross-polarization or circular or eliptical polarization can be obtained applying to the newly disclosed configurations the same conventional techniques described in the prior art.

DETAILED DESCRIPTION OF THE PREFERRED EMBODIMENTS

Figure 1:
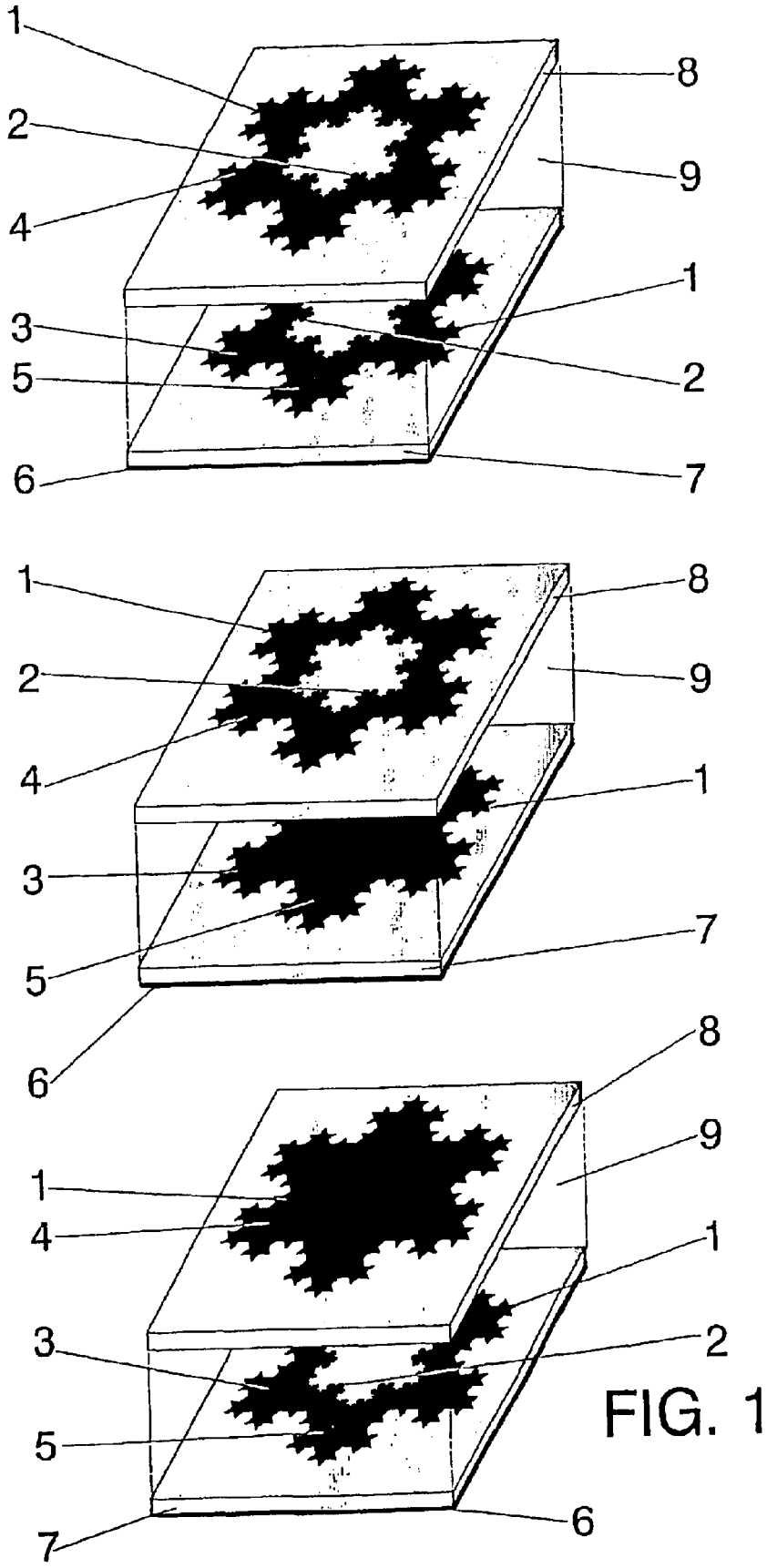
FIG. 1 Shows three different configurations for an MSFR antenna, with a RSFS for the active patch and parasitic patch(top), RSFS only for the parasitic patch (middle) or the RSFS for the active patch (bottom).

FIG. 1 describes three preferred embodiments for a MSFR antenna. The top one describes an antenna formed by an active patch (3) over a ground plane (6) and a parasitic patch (4) placed over said active patch where at least one of the patches is a RSFS (e.g. FIG. 1 (top) both patches are a RSFS, only the parasitic patch is a RSFS (middle) and only the active patch is a RSFS (bottom)). Said active and parasitic patches can be implemented by means of any of the well-known techniques for microstrip antennas already available in the state of the art, since its implemenation is not relevant to the invention. For instance, the patches can be printed over a dielectric substrate (7 and 8) or can be conformed through a laser cut process upon a metallic layer. Any of the well-known printed circuit fabrication techniques can be applied to pattern the RSFS over the dielectric substrate. Said dielectric substrate can be for instance a glass-fibre board, a teflon based substrate (such as Cuclad®) or other standard radiofrequency and microwave substrates (as for instance Rogers 4003® or Kapton®). The dielectric substrate can even be a portion of a window glass if the antenna is to be mounted in a motor vehicle such as a car, a train or an airplane, to transmit or receive radio, TV, cellular telephone (GSM 900, GSM 1800, UMTS) or other communication services of electromagnetic waves. Of course, a matching network can be connected or integrated at the input terminals of the active patch. The medium (9) between the active (3) and parasitic patch (4) can be air, foam or any standard radio frequency and microwave substrate. The said active patch feeding scheme can be taken to be any of the well-known schemes used in prior art patch antennas, for instance: a coaxial cable with the outer conductor connected to the ground-plane and the inner conductor connected to the active patch at the desired input resistance point (5). Of course the typical modifications including a capacitive gap on the patch around the coaxial connecting point or a capacitive plate connected to the inner conductor of the coaxial placed at a distance parallel to the patch, and so on can be used as well. Examples of other obvious feeding mechanisms are for instance a microstrip transmission line sharing the same ground-plane as the active patch antenna with the strip capacitively coupled to the active patch and located at a distance below the said active patch; in another embodiment the strip is placed below the ground-plane and coupled to the active patch through an slot, and even a microstrip transmission line with the strip co-planar to the active patch. All these mechanisms are well known from prior art and do not constitute an essential part of the present invention. The essential part of the present invention is the shape of the active patch and parasitic (in this case the RSFS geometry) which contributes to reducing the antenna size with respect to prior art configurations and enhances the bandwidth.

The dimensions of the parasitic patch is not necessarily the same than the active patch. Those dimensions can be adjusted to obtain resonant frequencies substantially similar with a difference less than a 20% when comparing the resonances of the active and parasitic elements.

Figure 2:
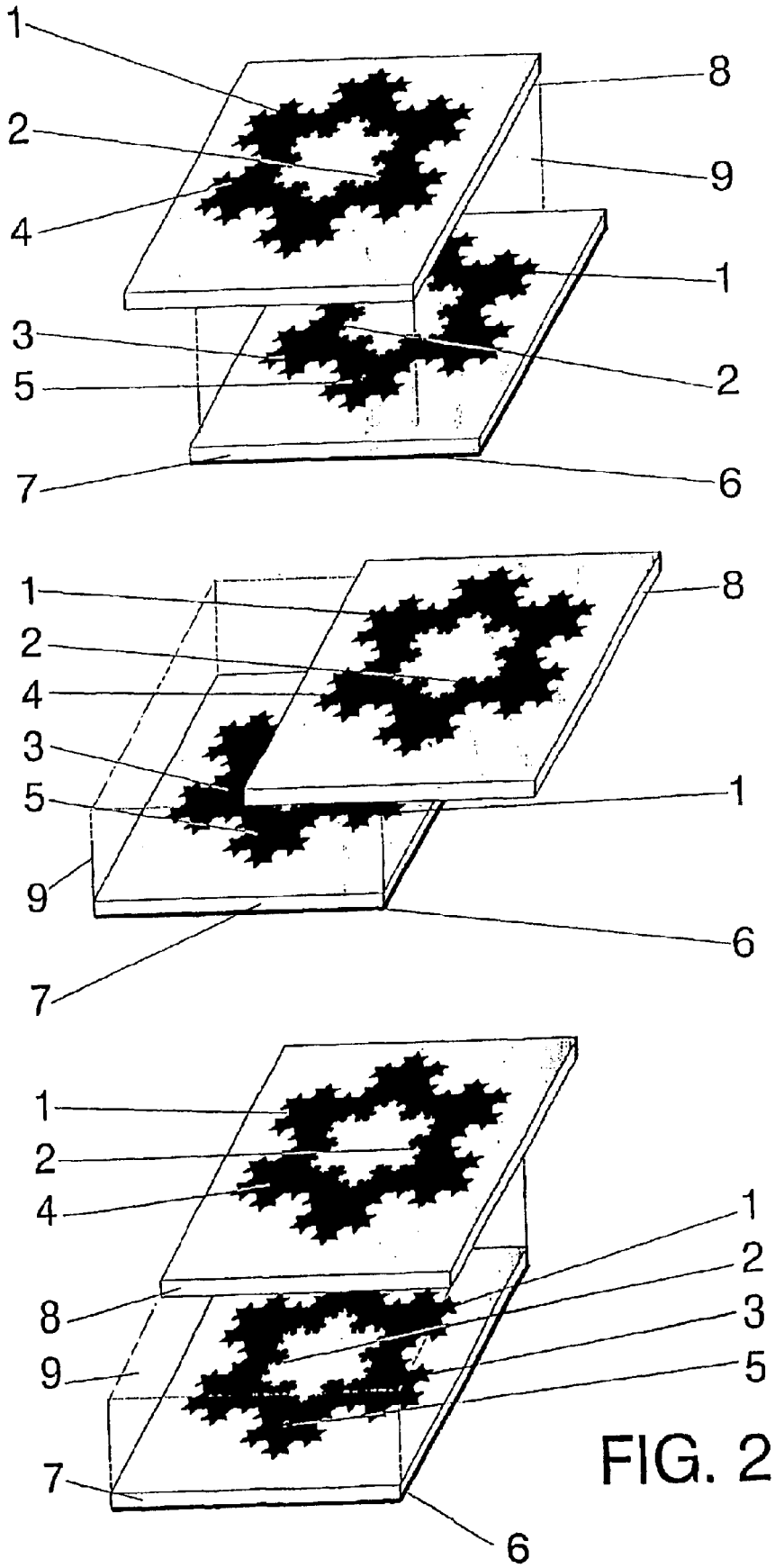
FIG. 2 Shows three different configurations for an MSFR antenna where the centre of active and parasitic patch do not lie on the same perpendicular axis to the groundplane.

FIG. 2 describes an other preferred embodiment where the centre of the said active (3) and parasitic patches (4) are not aligned on the same perpendicular axis to the groundplane (7). The top figure describes a horizontal and vertical misalignment, the middle describes a horizontal misalignment and the bottom describes a vertical misalignment. This misalignment is useful to control the beamwidth of the radiation pattern.

Figure 3:
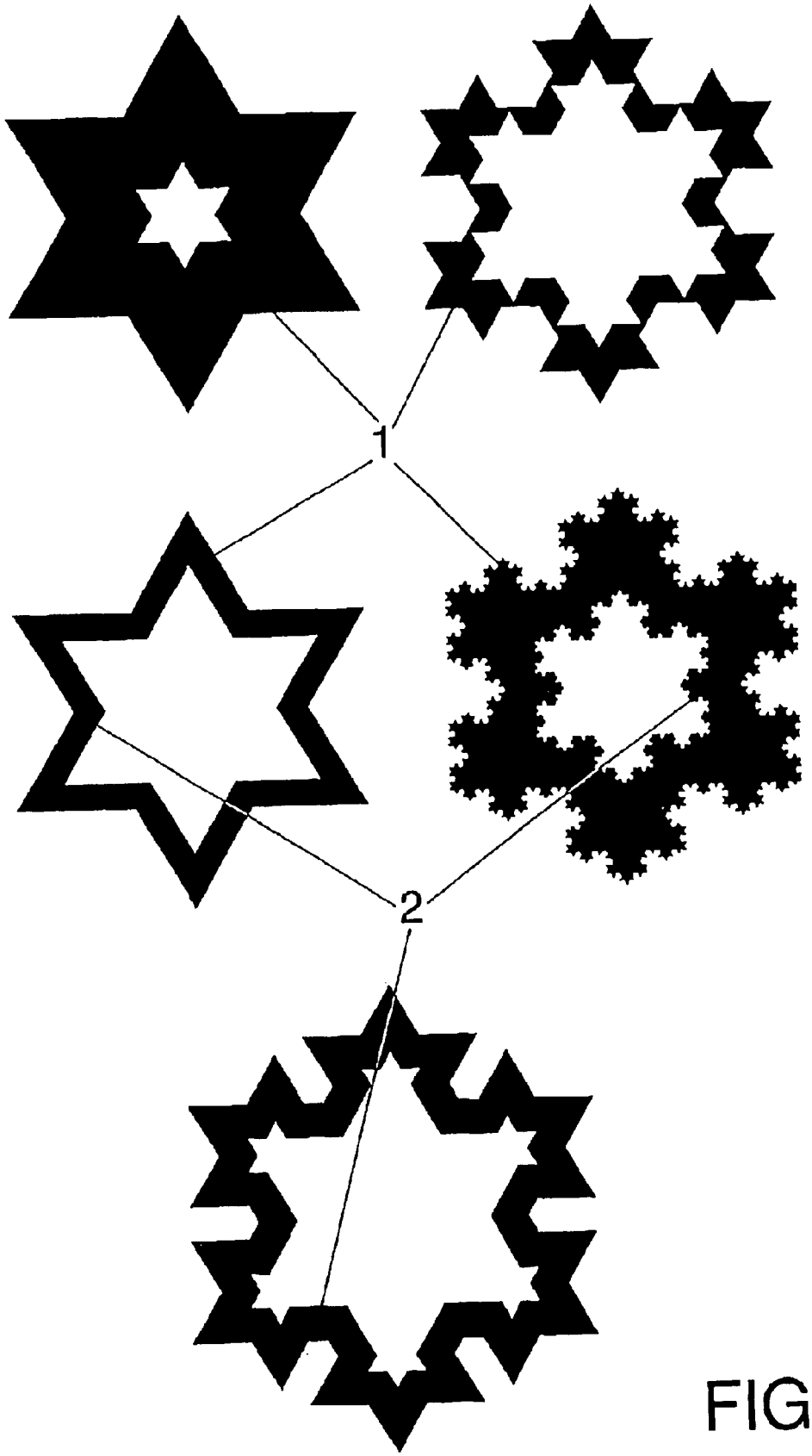
FIG. 3 Describes several RSFS examples wherein the outer and inner perimeters are based on the same curve and with the same number of segments.
Figure 4:
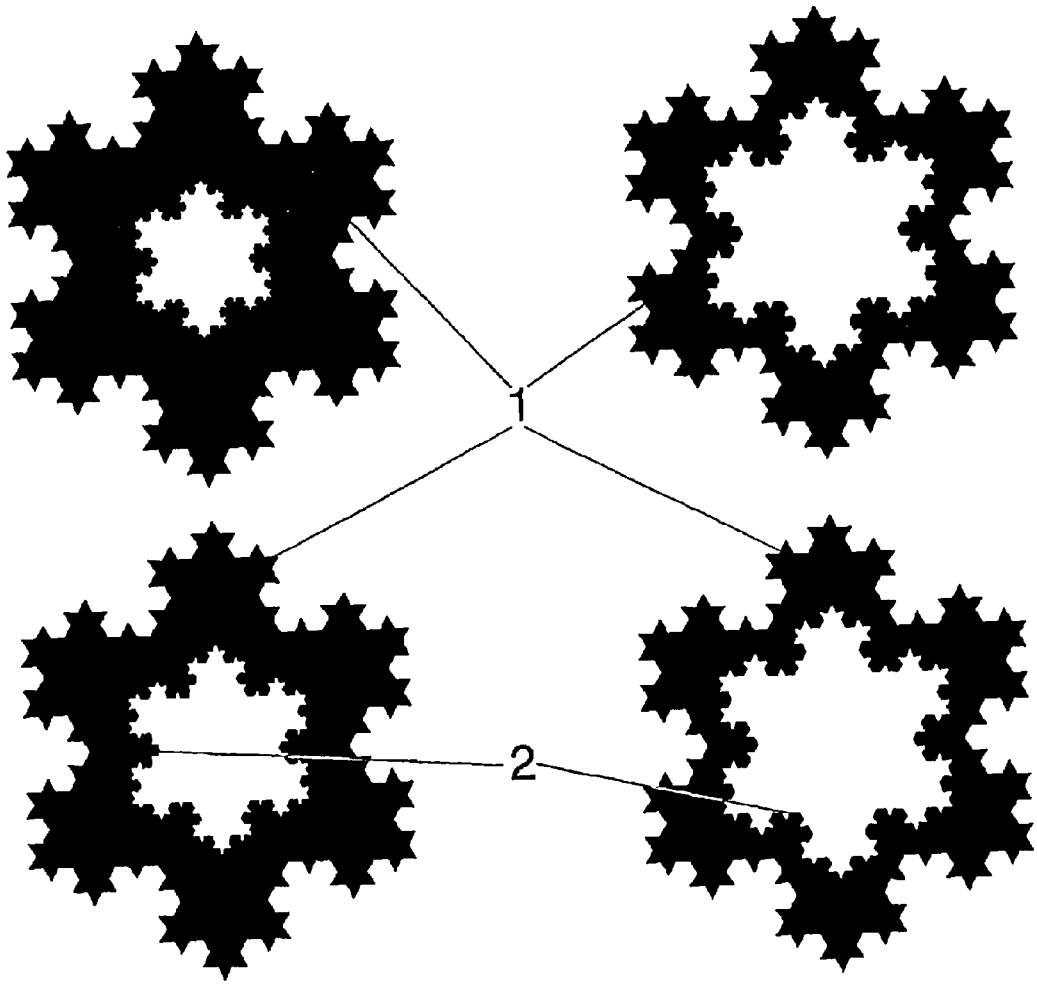
FIG. 4 Shows several RSFS examples based on the same curve wherein the outer and inner perimeter have different lengths for each case.
Figure 5:
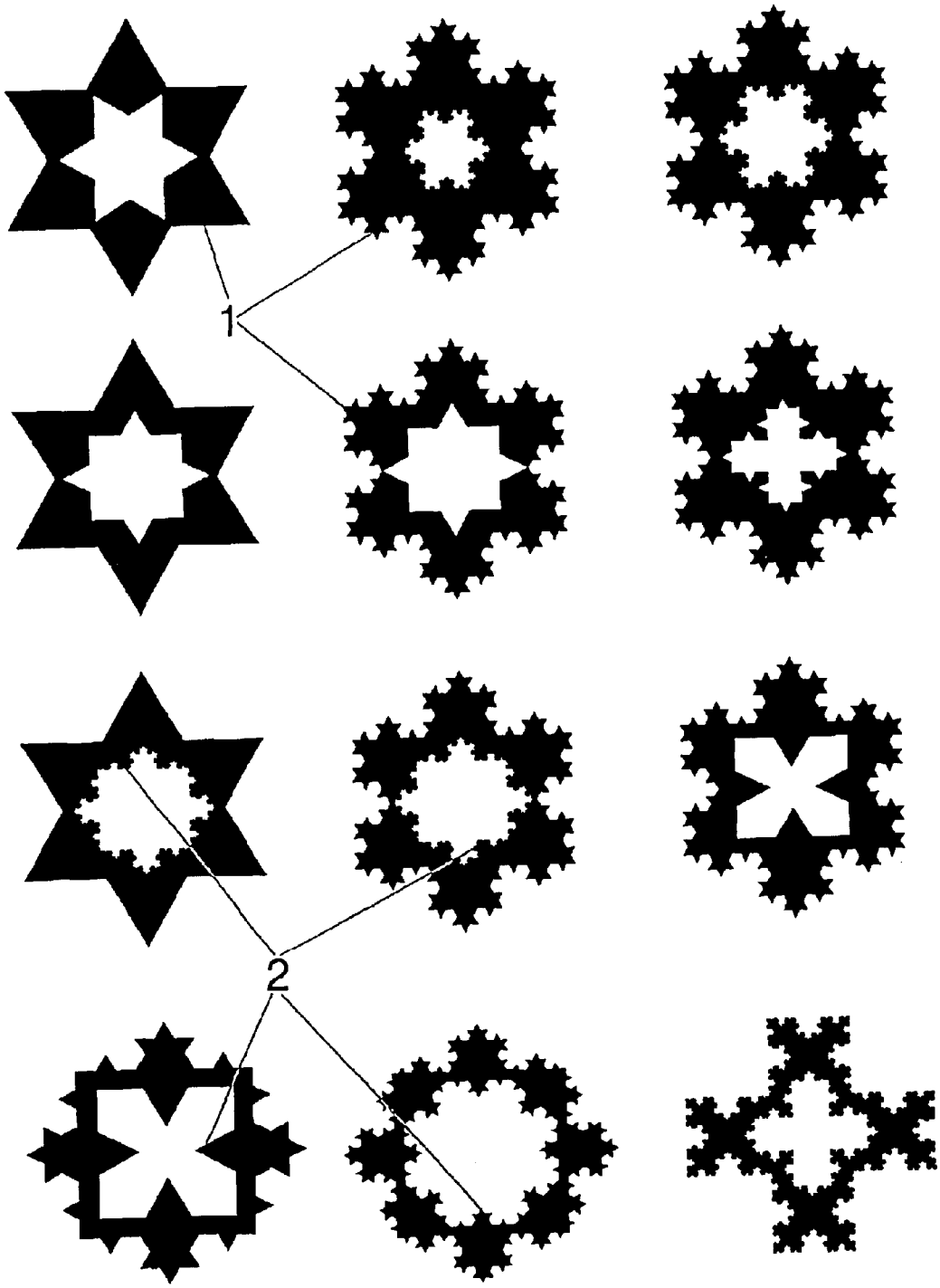
FIG. 5 Shows RSFS examples wherein the outer and inner perimeters are based on different curves with equal and not-equal number of segments.
Figure 6:
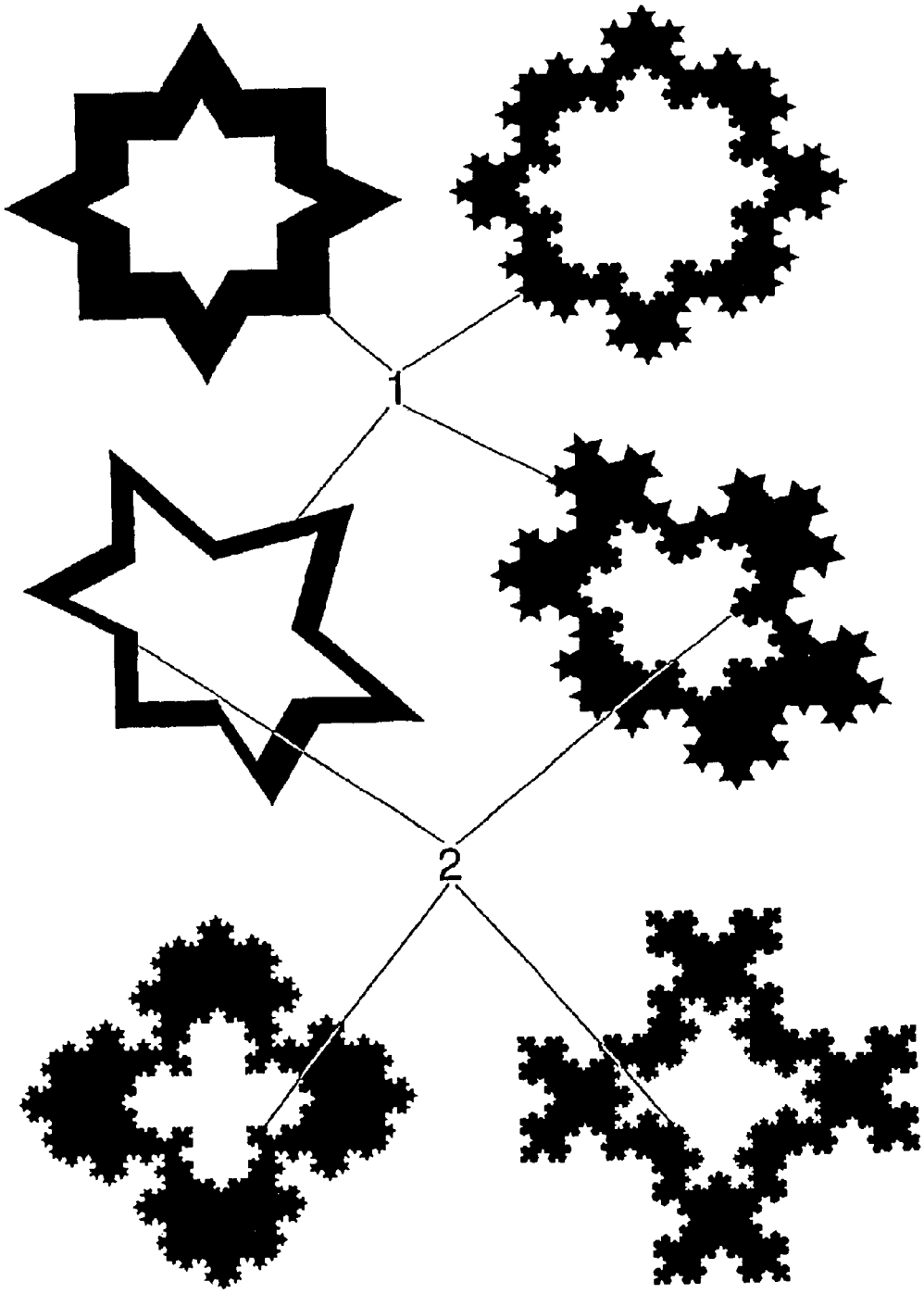
FIG. 6 Shows RSFS examples as those in FIG. 3, based on different SFC.
Figure 7:
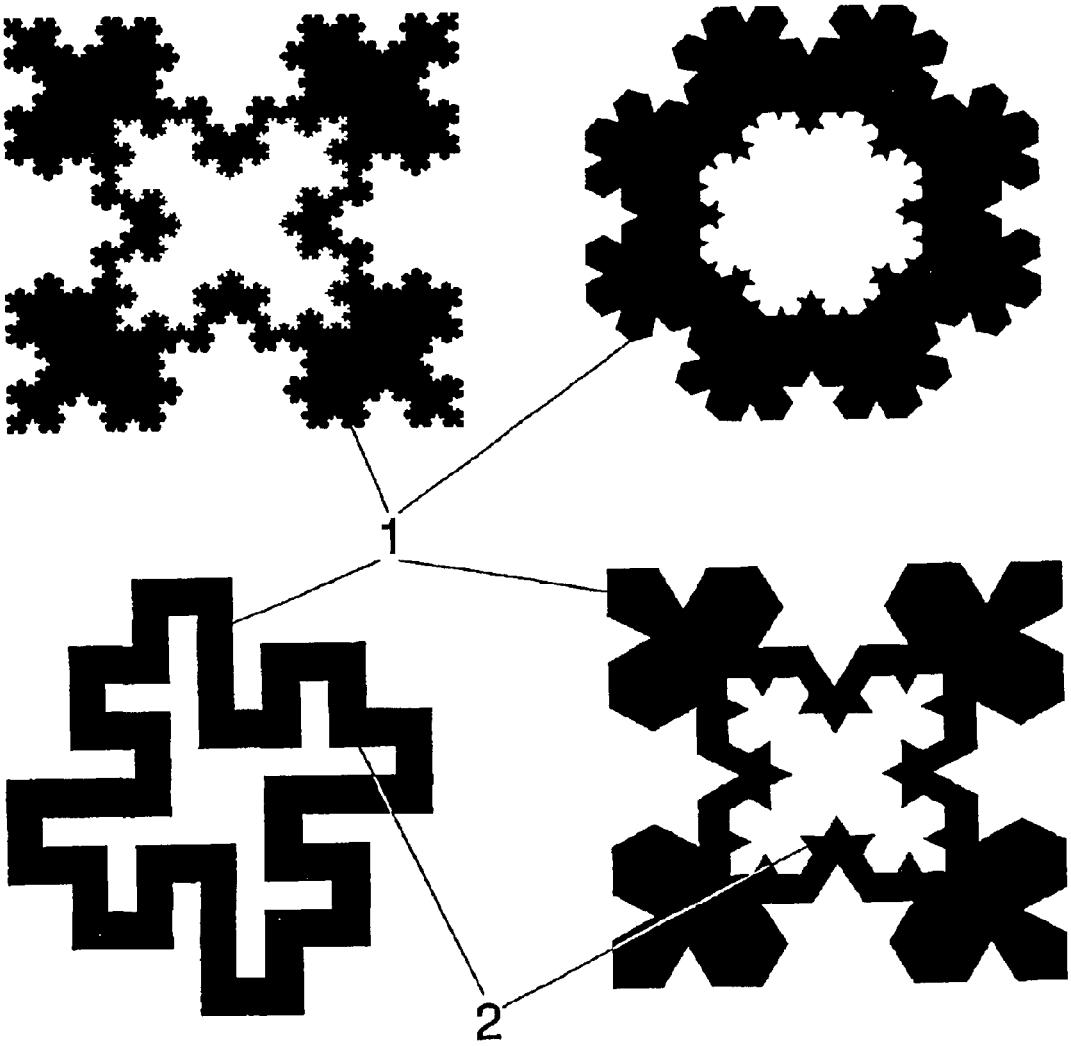
FIG. 7 More RSFS examples as those in FIG. 6

To illustrate several modifications either on the active patch or the parasitic patch, several examples are presented. FIG. 3 describes some RSFS either for the active or the parasitic patches where the inner (1) and outer perimeters (2) are based on the same SFC. FIG. 4 describes an other preferred embodiment with different inner perimeter length. This differences on the inner perimeter are useful to slightly modify and adjust the operating frequency. FIG. 5 describes an other preferred embodiment where the outer perimeter (1) of the RSFS is based on a different SFC than the inner (2) perimeter. FIGS. 6 and 7 describes other preferred embodiments with other examples of SFC curves, where the inner (1) and outer (2) perimeters of the RSFS are based on the same SFC.

Figure 8:
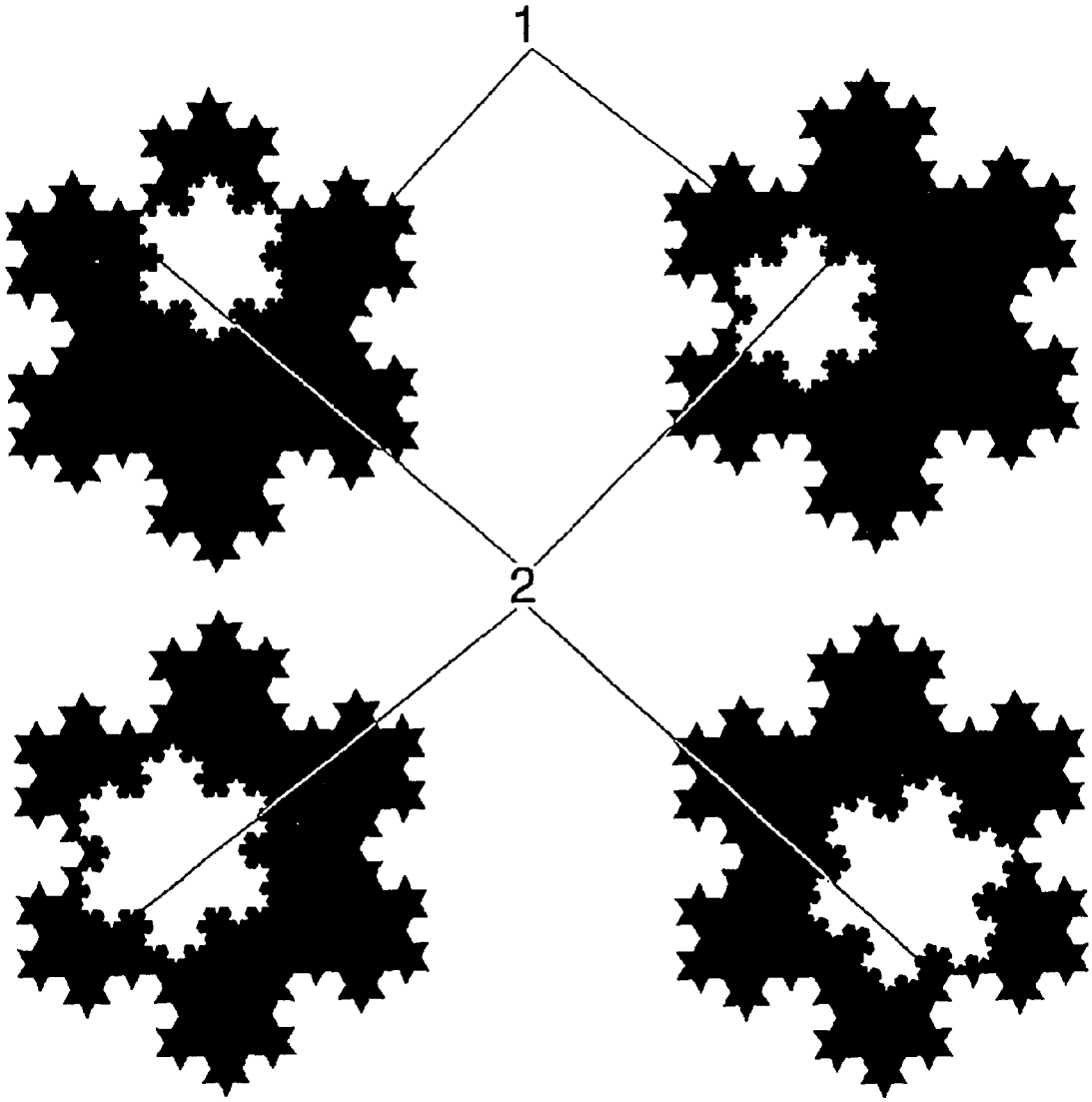
FIG. 8 Describes some RSFS examples where the centre of the whole structure do not coincide with the centre of the removed part.

FIG. 8 illustrates some examples where the centre of the removed part is not the same than the centre of the patch. This centre displacement is specially useful to place the feeding point on the active patch to match the MSFR antenna to a specific reference impedance. In this way the can features an input impedance above 5 Ohms.

Figure 9:
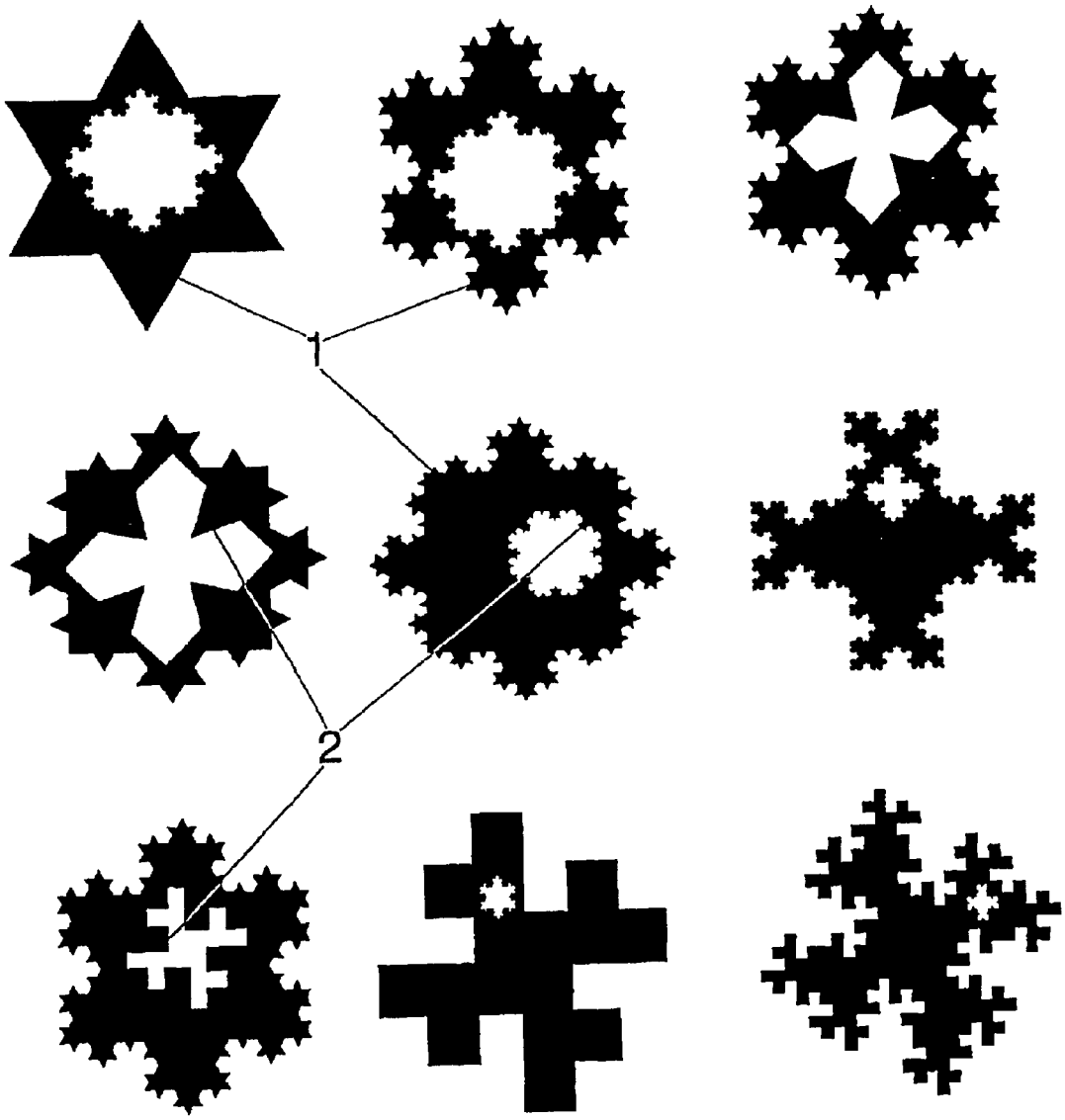
FIG. 9 Shows RSFS examples with different SFC for the inner and outer perimeter and with the centre of the whole structure placed different than the centre of the removed part.

FIG. 9 describes other preferred embodiments with several combinations: centre misalignments where the outer (1) and inner perimeters of the RSFC are based on different SFC.

Figure 10:
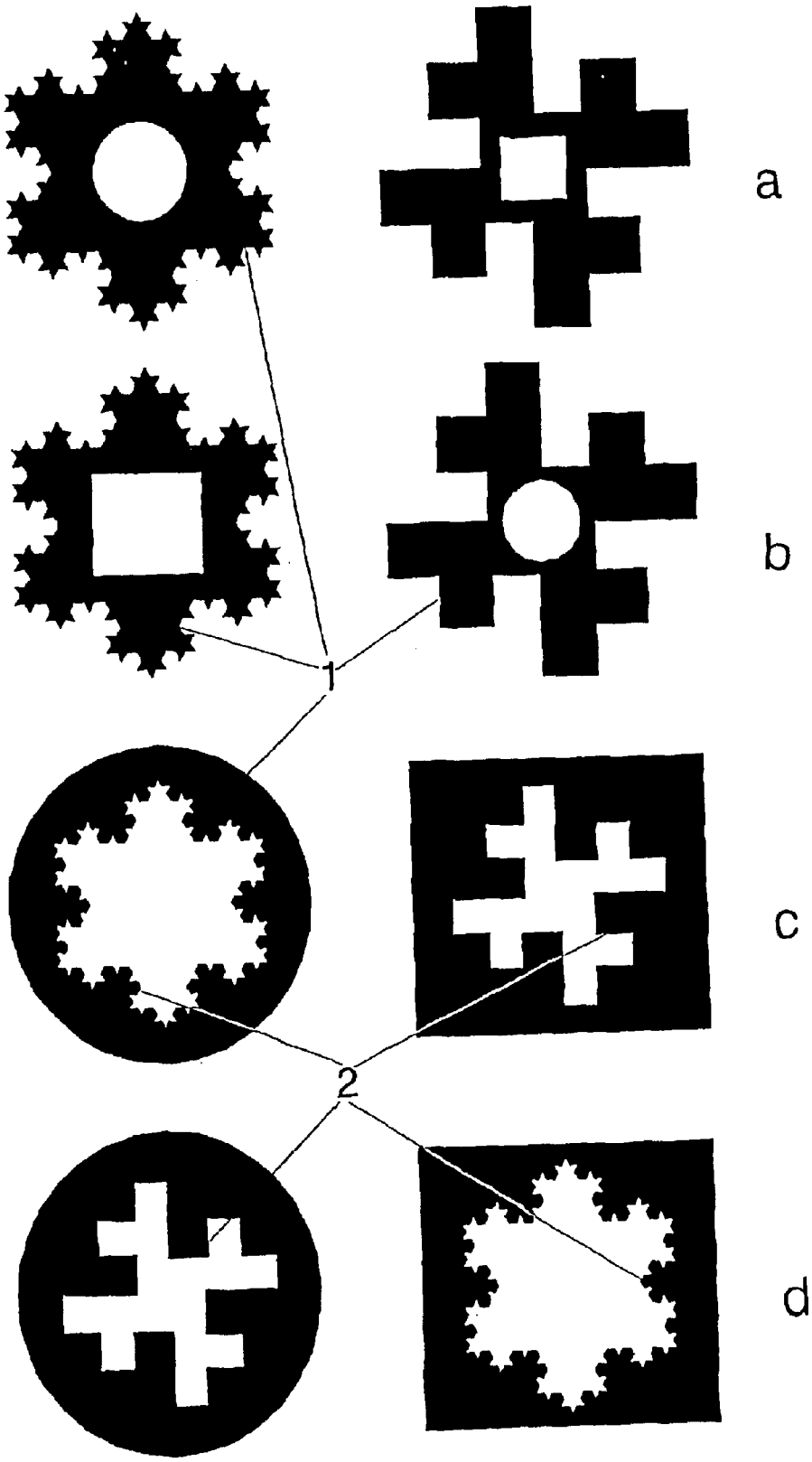
FIG. 10 Describes RSFS examples where the outer perimeter is a SFC (FIGS. a and b) and the inner perimeter is a classical Euclidean curve (e.g. square, circle, triangle . . . ). FIGS. c and d where the outer perimeter is a conventional poligonal geometry (e.g. square, circle, triangle . . . ) and where the inner perimeter is a SFC.

FIG. 10 Describes another preferred embodiment (FIGS. a and b) where the outer perimeter (1) of the RSFS is a SFC and the inner perimeter is a conventional Euclidean curve (e.g. square, circle . . . ). And examples illustrated in figures c and d where the outer perimeter of the RSFS (1) is a classical Euclidean curve (e.g. square, circle, . . . ) and the inner perimeter (2) is a SFC.

Having illustrated and described the principles of our invention in several preferred embodiments thereof, it should be readily apparent to those skilled in the art that the invention can be modified in arrangement and detail without departing from such principles.

What is claimed is:

1. A miniature broadband microstrip patch antenna comprising at least first and a second conducting parallel surfaces and a conducting ground plane the first conducting surface acting as an active element being placed substantially parallel on top of said ground plane and including a feeding point, the second conducting surface acting as a parasitic element placed above said first surface, said patch antenna characterized in that at least one of said first or second conducting surfaces consists of a planar ring comprising an inner and outer perimeter wherein the shape of at least one of said inner and outer perimeters is a space-filling curve, said space-filling curve being composed by at least ten segments, said segments connected with each adjacent segment, and forming an angle with each adjacent segment, no pair of adjacent segments defining a larger straight segment, wherein said space-filling curve never intersects with itself at any point except the initial and final points, and wherein said segments must be shorter than a tenth of the free-space operating wavelengths.

2. A miniature broadband microstrip patch antenna according to claim 1, wherein at least one of said conducting surfaces is displaced laterally such that the two axes that orthogonally cross the center of both surfaces do not overlap.

3. A miniature broadband microstrip patch antenna according to claim 1 or 2 wherein said antenna further comprises a dielectric, magnetic or magneto dielectric material placed below or above at least one of said or second conducting surfaces.

4. A miniature broadband microstrip patch antenna according to claims 1 or 2 wherein the first and second conducting surfaces each has a frequency, and the resonant frequencies of the first and second conducting surfaces are substantially similar with a difference less than 20%.

5. A miniature broadband microstrip patch antenna according to claims 1 or 2 wherein the inner and outer perimeters each has a center, and the center of said inner perimeter does not match the position of the center of said outer perimeter and the antenna features an input impedance above 5 Ohms.

6. A miniature broadband microstrip patch antenna according to claims 1 or 2 wherein the antenna is operated at a frequency mode of larger order than the fundamental frequency to feature a high gain radiation pattern.

* * * * *

UNITED STATES PATENT AND TRADEMARK OFFICE

CERTIFICATE OF CORRECTION

PATENT NO. : 6,870,507 B2
DATED : March 22, 2005
INVENTOR(S) : Anguera Pros et al.

It is certified that error appears in the above-identified patent and that said Letters Patent is hereby corrected as shown below:

Column 6,
Line 1, after the "plane" insert a comma -- , --.
Line 19, delete "wavelengths" and insert -- wavelength --.
Line 26, delete "claim" and insert -- claims --.
Line 28, after "said" insert -- first --.
Line 32, after "a" insert -- resonant --.

Signed and Sealed this

Ninth Day of August, 2005

JON W. DUDAS
*Director of the United States Patent and Trademark Office*